US005800316A

United States Patent [19]

Huang

[11] Patent Number: 5,800,316

[45] Date of Patent: Sep. 1, 1998

[54] RESISTANCE DEVICE FOR AN EXERCISER

[76] Inventor: Kung-Da Huang, No. 369, Tung-An Rd., Tainan City, Taiwan

[21] Appl. No.: 857,928

[22] Filed: May 16, 1997

[51] Int. Cl.[6] ..... A63B 23/04

[52] U.S. Cl. ..... 482/61; 482/63

[58] Field of Search ..... 482/57, 61, 62, 482/63, 963, 114, 115, 118, 119

[56] References Cited

U.S. PATENT DOCUMENTS

| | | | |
|---|---|---|---|
| 4,441,705 | 4/1984 | Brown | 482/61 |
| 4,826,150 | 5/1989 | Minoura | 482/61 |
| 5,468,201 | 11/1995 | Minoura | 482/61 |
| 5,472,392 | 12/1995 | Haan et al. | 482/61 |

*Primary Examiner*—Stephen R. Crow
*Attorney, Agent, or Firm*—Fish & Richardson P.C.

[57] ABSTRACT

A resistance device is to be used with an exerciser having an axle, a wheel mounted on the axle, and a driving unit which is manually operable to drive rotatably the wheel on the axle. The resistance device includes a support frame and a resistance unit. The support frame is adapted to be mounted on the exerciser so as to raise the wheel above a ground surface to prevent the ground surface from providing resistance to rotation of the wheel. The resistance unit includes a transmission shaft mounted rotatably on the support frame and adapted to be driven rotatably by the wheel, and weights applied on the transmission shaft so as to generate a resistance to rotation of the transmission shaft in order to resist, in turn, the rotation of the wheel.

15 Claims, 5 Drawing Sheets

RESISTANCE DEVICE FOR AN EXERCISER

BACKGROUND OF THE INVENTION

1. Field of the Invention

The present invention relates to a resistance device which is adapted to be mounted on an exerciser so as to provide resistance thereto.

2. Description of the Related Art

An exerciser is generally used for exercising body parts of the user. A conventional bicycle exerciser works like an ordinary bicycle but cannot be used for transportation purposes. On the other hand, a conventional bicycle cannot be used indoors due to lack of sufficient space for movement of the bicycle. Therefore, since a conventional bicycle exerciser and a conventional bicycle cannot be used alternatingly as desired, there is thus a need for a resistance device which can be used with a conventional bicycle for converting the latter into an indoor exerciser and which can provide resistance to the bicycle for exercising purposes.

SUMMARY OF THE INVENTION

The main object of the present invention is to provide a resistance device which is adapted to be mounted on an exerciser, such as a bicycle, and which can impart resistance to the exerciser.

Accordingly, the resistance device of the present invention is to be used with an exerciser, such as a bicycle, which has an axle, a wheel mounted on the axle, and a driving unit which is manually operable to drive rotatably the wheel on the axle. The resistance device includes a support frame and a resistance unit. The support frame is adapted to be mounted on the exerciser so as to raise the wheel above a ground surface to prevent the ground surface from providing resistance to rotation of the wheel. The resistance unit includes a transmission shaft, weighting means, a contact roller, and parallel first and second support members. The transmission shaft is mounted rotatably on the support frame and is adapted to be driven rotatably by the wheel. The transmission shaft has opposite first and second end portions. The weighting means is applied on the transmission shaft so as to generate a resistance to rotation of the transmission shaft in order to resist, in turn, the rotation of the wheel. The weighting means includes first and second balancing weights sleeved respectively on the first and second end portions of the transmission shaft for co-rotation therewith. The contact roller is sleeved on the transmission shaft and is adapted to be placed in contact with the wheel such that rotation of the wheel by the driving unit results in co-rotation of the contact roller and the transmission shaft therewith. The first and second support members are mounted on the support frame. Each of the support members has a mounting hole provided with a bearing unit for supporting rotatably a respective one of the first and second end portions of the transmission shaft thereon. The contact roller is disposed between the support members.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
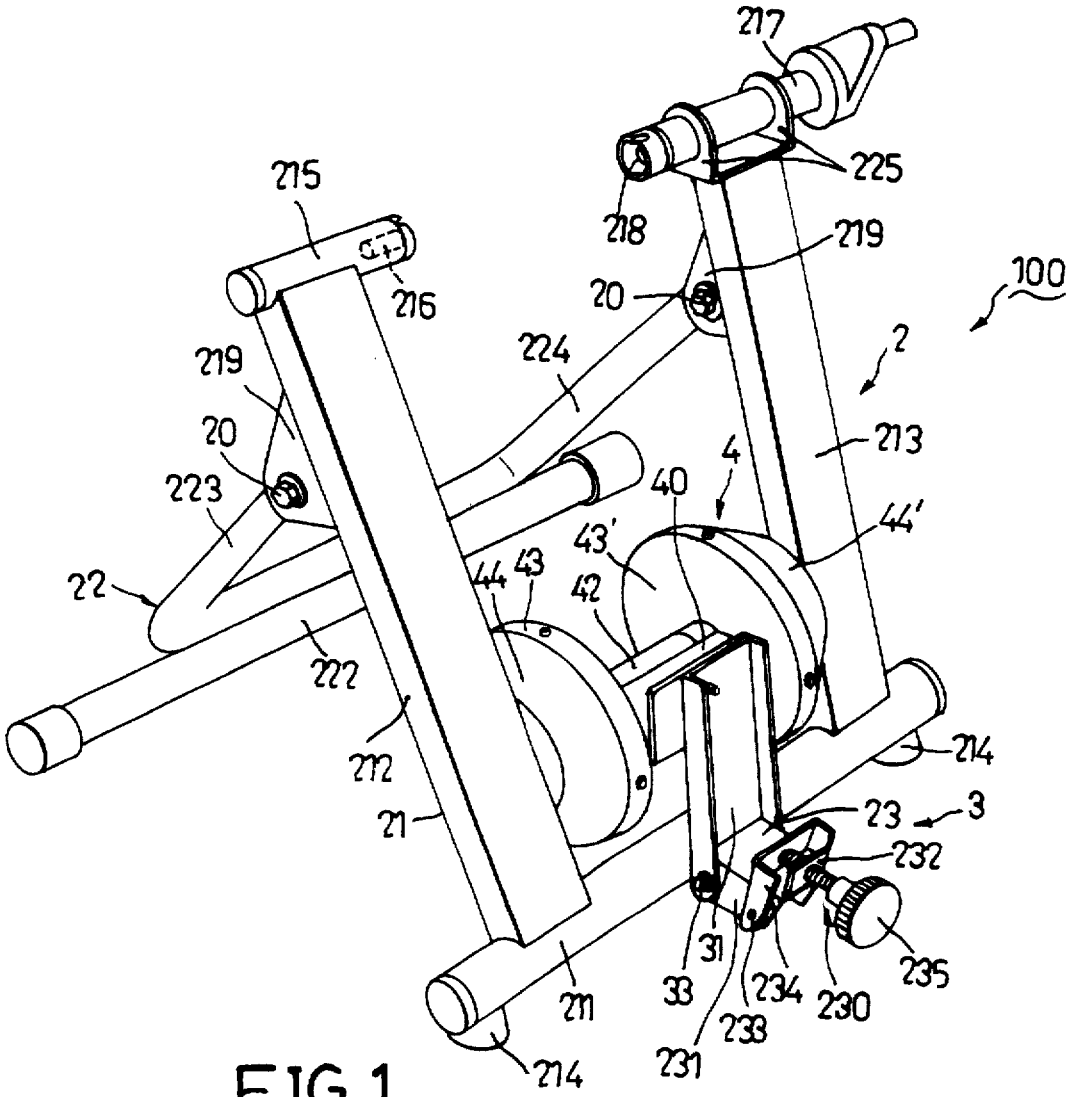
FIG. 1 is a perspective view illustrating a resistance device according to a first preferred embodiment of the present invention.
Figure 2:
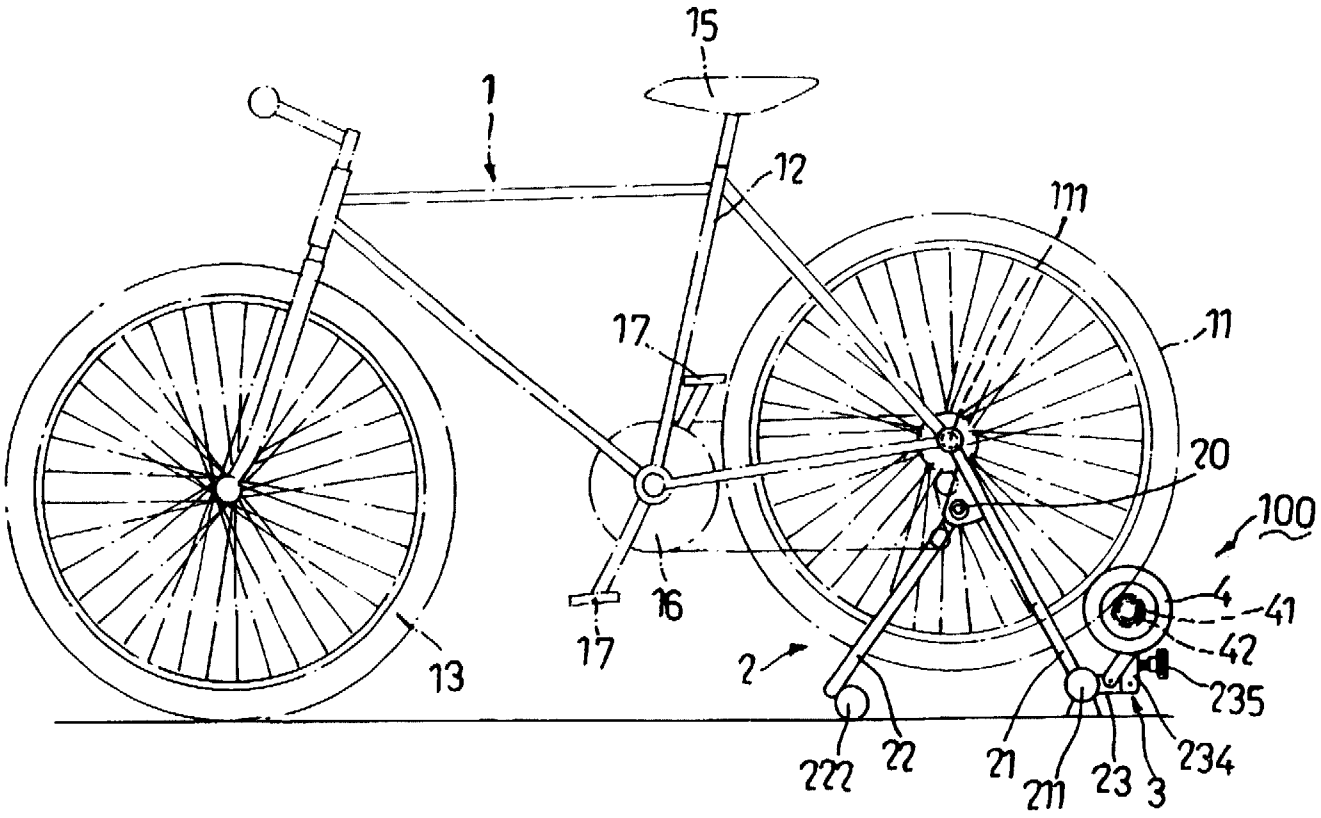
FIG. 2 illustrates the resistance device of the first preferred embodiment when mounted on a bicycle.

Referring to FIGS. 1 and 2, the resistance device 100 according to a first preferred embodiment of this invention is shown to be used with an exerciser, such as a bicycle 1. The bicycle 1 includes a bicycle frame 12, a seat 15 mounted on a top end of the bicycle frame 12, a front wheel 13 mounted on a front end of the bicycle frame 12, an axle 111 provided on a rear end of the bicycle frame 12, a rear wheel 11 mounted on the axle 111, and a crank mechanism 17 and a drive chain 16 which serve as a driving unit and which is manually operable so as to drive rotatably the rear wheel 11 on axle 111. The resistance device 100 includes a support frame 2, a resistance unit 4 and an adjustable positioning unit 3.

The support frame 2 is adapted to be mounted removably on the bicycle 1 and includes a U-shaped first frame portion 21 with a parallel pair of upright first arm sections 212, 213, and a U-shaped second frame portion 22 with a parallel pair of upright second arm sections 223, 224. The first and second arm sections 212, 213, 223, 224 form a space which is adapted to permit extension of the rear wheel 11 of the bicycle 1 therebetween. The first frame portion 21 has a first bottom rail 211 interconnecting the first arm sections 212, 213 thereof and parallel to the axle 111 of the bicycle 1. The first bottom rail 211 has a bottom side provided with two spaced foot members 214 to prevent sliding of the support frame 2 on a ground surface. A second bottom rail 222 parallel to the axle 111 of the wheel 11 is secured to a lower end of the second frame portion 22. Each of the upright first arm sections 212, 213 has one side facing the second frame portion 22 and formed with a pivoting lobe 219. Each of the second arm sections 223, 224 of the second frame portion 22 has a top end mounted pivotally, foldably and respectively to the pivoting lobes 219 on the first arm sections 212, 213 of the first frame portion 21 by means of a pair of first pivot members 20. One of the first arm sections 212 has a top end provided with a first positioning tube 215 which is formed with a first receiving hole 216. The other one of the first arm sections 213 has a top end which is formed with a pair of lobe pieces 225 having aligned holes and which is provided with a second positioning tube 217 that extends through the aligned holes of the lobe pieces 225 so as to be movably supported by the same. The second positioning tube 217 is coaxial with the first positioning tube 215 and is formed with a second receiving hole 218 confronting the first receiving hole 216 of the first positioning tube 215. The second positioning tube 217 is movable toward and away from the first positioning tube 215. The first and second receiving holes 216, 218 of the first and second positioning tubes 215, 217 are adapted to receive opposite ends of the axle 111 so as to support the wheel 11 at a raised position above the ground surface to prevent the ground surface from providing resistance to rotation of the wheel 11.

Figure 3:
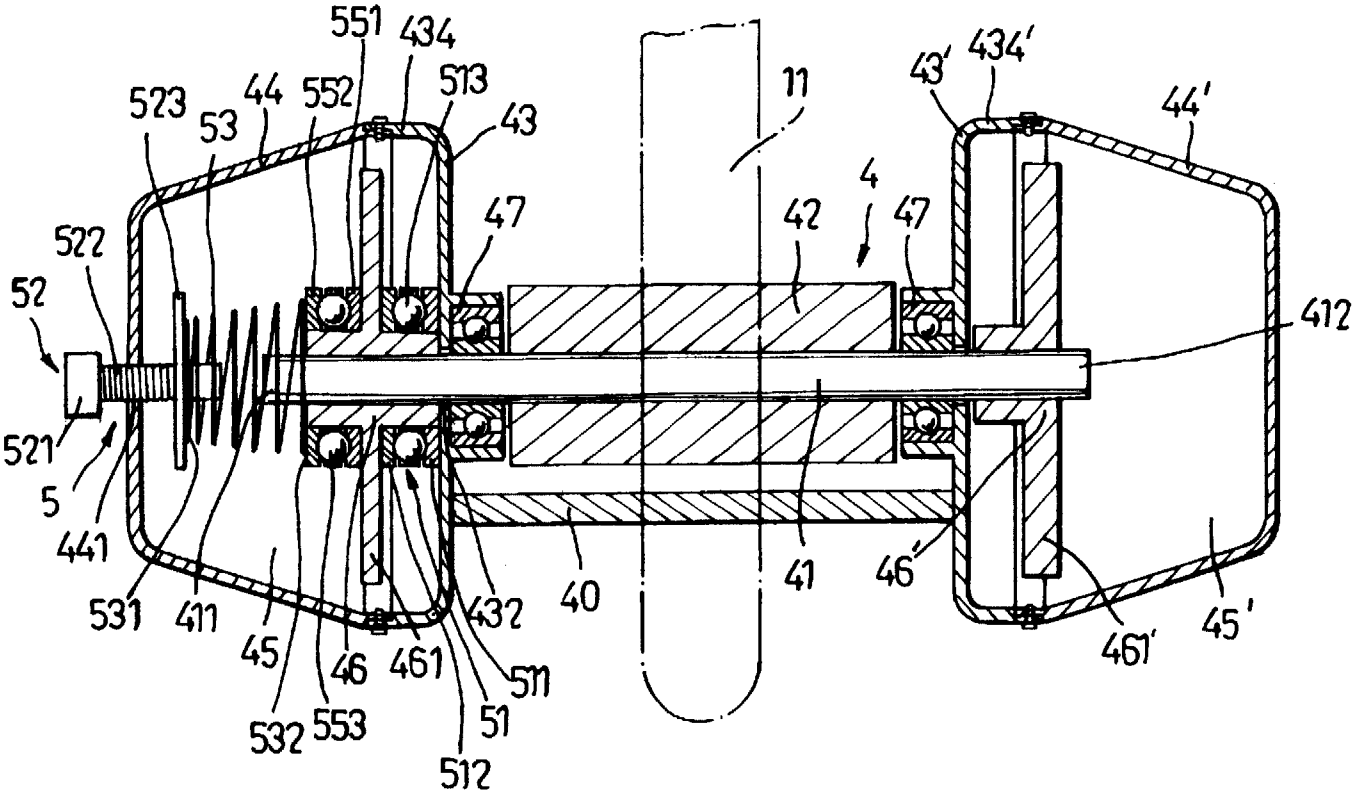
FIG. 3 is a cross-sectional view illustrating the resistance device of the first preferred embodiment.

Referring to FIGS. 2 and 3, the resistance unit 4 includes a transmission shaft 41 parallel to the axle 111 of the wheel 11. The transmission shaft 41 has a first end portion 411 and an opposite second end portion 412. A contact roller 42 is sleeved securely on the transmission shaft 41 and is adapted to be placed in contact with the wheel 11 such that rotation of the wheel 11 results in co-rotation of the contact roller 42 and the transmission shaft 41 therewith. The first and second end portions 411, 412 of the transmission shaft 41 are respectively supported on parallel first and second support members 43, 43'. The first and second support members 43, 43' are connected securely to each other by means of a linking plate 40 which is disposed therebetween and which is parallel to the transmission shaft 41. In this embodiment, each of the first and second support members 43, 43' is in the form of a vertical plate formed with a mounting hole 432 which is provided with a bearing unit 47 for supporting rotatably a respective one of the first and second end portions 411, 412 of the transmission shaft 41 thereon. The contact roller 42 is disposed between the support members 43, 43'. The resistance unit 4 further includes a first balancing weight 46 and a second balancing weight 46' which are sleeved securely and respectively on the first and second end portions 411, 412 of the transmission shaft 41 for rotation together with the transmission shaft 41. The first and second balancing weights 46, 46' cooperatively serve as weighting means applied on the transmission shaft 41 so as to generate a resistance to rotation of the transmission shaft 41 in order to resist, in turn, rotation of the wheel 11. Each of the first and second balancing weights 46, 46' has an increased-diameter section 461, 461'. The resistance unit 4 further includes a first covering 44 which is fastened to a rim portion 434 of the first support member 43 and which cooperates with the first support member 43 to confine a first accommodation chamber 45 for enclosing the first balancing weight 46 therein. For aesthetic purposes, a second covering 44' is mounted on a rim portion 434' of the second support member 43' and cooperates with the second support member 43' to confine a second accommodation chamber 45' for enclosing the second balancing weight 46' therein.

The resistance unit 4 further includes a first resistance bearing 51 sleeved on the first end portion 411 of the transmission shaft 41 and disposed between a first side of the increased-diameter section 461 of the first balancing weight 46 and the first support member 43. The first resistance bearing 51 includes a first race 511 adjacent to the first support member 43, a second race 512 adjacent to the increased-diameter section 461 of the first balancing weight 46, and first bearing balls 513 disposed between the first and second races 511, 512. A second resistance bearing 55 is also sleeved on the first end portion 411 of the transmission shaft 41 and is disposed on a second side of the increased-diameter section 461 of the first balancing weight 46 opposite to the first side thereof. The second bearing 55 includes a third race 551 adjacent to the increased diameter section 461 of the first balancing weight 46, a fourth race 552, and second bearing balls 553 disposed between the third and fourth races 551, 552.

The resistance unit 4 further comprises adjustable resistance means 5 which includes an operating unit 52 and an abutting member 53. The operating unit 52 has a first end portion which extends into the first covering 44 and which has a stop plate 523 provided thereon, a second end portion 521 which extends out of the first covering 44 to permit manual operation thereof, and a threaded section 522 between the second end portion 521 and the stop plate 523. The abutting member 53 is formed as a spiral coiled spring with a first side 531 abutting against the stop plate 523 of the operating unit 52, and a second side 532 abutting against the fourth race 552 of the second resistance bearing 55. The second resistance bearing 55 is thus urged by the abutting member 53 toward the increased-diameter section 461 of the first balancing weight 46, and the first balancing weight 46 is urged, in turn, toward the first resistance bearing 51 such that the second and third races 512, 551 rotate with the first balancing weight 46 relative to the first and fourth races 511, 552. The first covering 44 is formed with a threaded hole 441 which engages the threaded section 522 of the operating unit 52. The operating unit 52 is operable to move the abutting member 53 toward and away from the second resistance bearing 55 to vary compression force applied by the abutting member 53 to the fourth race 552 of the second resistance bearing 55 so as to vary the resistances of the first and second bearing balls 513, 553 to rotation of the second and third races 512, 551 to adjust, in turn, resistance to rotation of the first balancing weight 46 together with the transmission shaft 41.

Referring again to FIGS. 1 and 2, the adjustable positioning unit 3 includes a horizontal positioning plate 23, an upright pivot plate 31, a regulating plate 234, and a regulating rod 230. The horizontal positioning plate 23 has a first end portion secured to the first bottom rail 211 of the first frame portion 21 of the support frame 2, an opposite second end portion formed with an upwardly extending wall 232, and a pair of downwardly extending flanges 231 between the first and second end portions. The upright pivot plate 31 has an upper end portion disposed between the first and second support members 43, 43' and secured to the linking plate 40, which is secured to the support members 43, 43', and a lower end portion mounted pivotally on the flanges 231 at the first end portion of the positioning plate 23 by means of a second pivot member 33. The regulating plate 234 has a lower end portion mounted pivotally on the flanges 234 of the positioning plate 23 between the first and second end portions of the latter by means of a third pivot member 233, and an upper end portion which permits resting of the pivot plate 31 inclinedly thereon. The regulating rod 230 extends threadedly through the upwardly extending wall 232, and has a first end abutting against the regulating plate 234 and a second end provided with a regulating knob 235. The regulating knob 235 is rotatable to move the regulating rod 230 relative to the upwardly extending wall 232 so as to support the regulating plate 234 in a desired inclined position, thereby permitting varying of the inclination of the pivot plate 31. The position of the contact roller 42 relative to the wheel 11 is thus adjustable to suit the size of the wheel 11.

Referring to FIGS. 1 to 3, in use, the second frame portion 22 is unfolded from the first frame portion 21. One end of the axle 111 of the bicycle 1 is inserted into the first receiving hole 216 of the first positioning tube 215. The second positioning tube 217 is then moved on the lobe pieces 225 so that the other end of the axle 111 is received in the second receiving hole 218 of the second positioning tube 217. The rear wheel 111 of the bicycle 1 is thus suspended above the ground surface. The regulating knob 235 is operated to move the regulating plate 234 and thus adjust the position of the contact roller 42 until the contact roller 42 is in contact with the wheel 11. When the crank mechanism 17 is driven by a person seated on the seat 15 of the bicycle 1 so as to drive the rear wheel 11 to rotate on the axle 111, the rotation of the rear wheel 11 is resisted by the first and second balancing weights 46, 46' since the rear wheel 11 is in contact with the contact roller 42. To increase the resistance to the rotation of the wheel 11, the operating unit 52 is threaded inwardly toward the first covering 44 to increase the compression force applied by the abutting member 53 on the second resistance bearing 55, the first balancing weight 46, and the first resistance bearing 51 and increase the resistance to rotation of the first balancing weight 46 together with the transmission shaft 41, thereby increasing the resistance to rotation of the transmission shaft 41. Conversely, to lower the resistance to the rotation of the wheel 11, the operating unit 52 is threaded outwardly of the covering 44.

Figure 4:
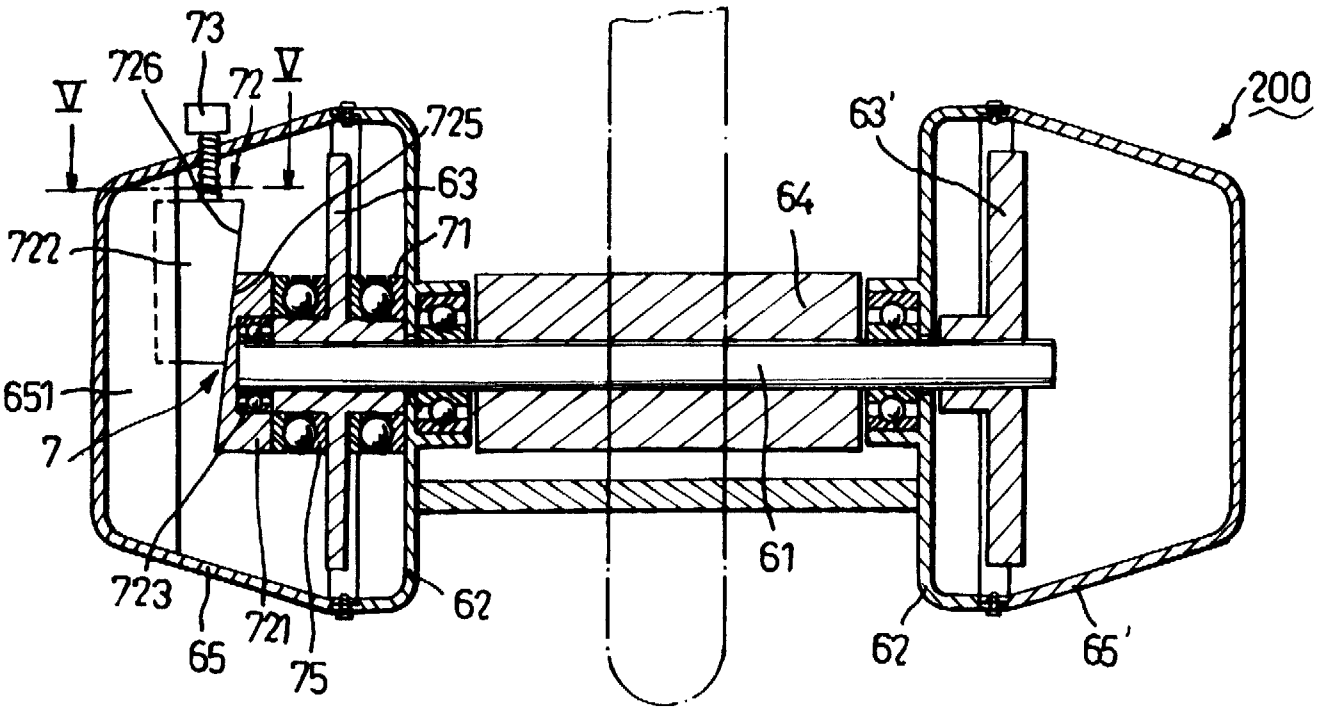
FIG. 4 is a cross-sectional view illustrating a resistance device according to a second preferred embodiment of the present invention.
Figure 5:
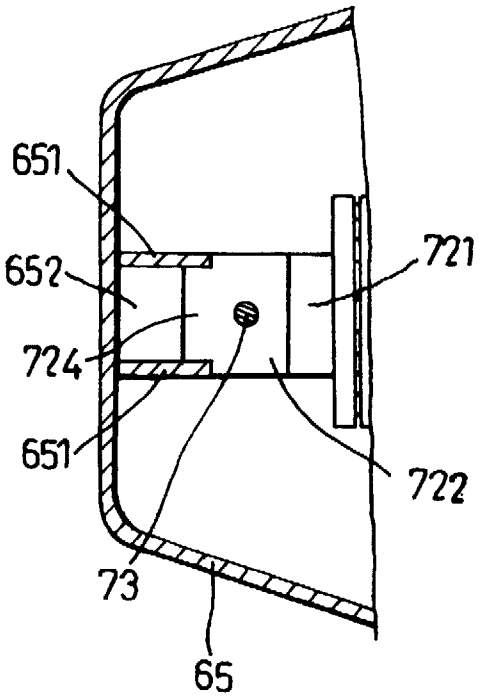
FIG. 5 is a sectional view of the resisting device of FIG. 4, taken along line V-V in FIG. 4.

Referring to FIGS. 4 and 5, a resistance device 200 according to a second preferred embodiment of the present invention is shown to include a transmission shaft 61 which is supported on parallel first and second support members 62 and which has first and second balancing weights 63, 63' and a contact roller 64 sleeved securely thereon. A first covering 65 and a second covering 65' are respectively mounted on the first and second support members 62 for enclosing the first and second balancing weights 63, 63' therein. A first resistance bearing 71 and a second resistance bearing 75 are respectively disposed on two sides of the first balancing weight 63. The resistance device 200 further includes adjustable resistance means 7 which has a different structure as compared to the adjustable resistance means 5 of the previous embodiment.

The adjustable resistance means 7 includes an operating unit 72 and an abutting member 721. The operating unit 72 includes a threaded shank 73 extending out of the first covering 65 to permit manual operation thereof, and a wedging block 722 which is secured to one end of the threaded shank 73 and which extends into the first covering 65. The wedging block 722 is formed with an inclined wedge face 726. The first covering 65 is formed with a threaded hole which engages the threaded shank 73. The abutting member 721 has a first side abutting against the wedging block 722 and formed as an inclined wedging face 725 which confronts the wedge face 726 of the wedging block 722, and a second side abutting against the second resistance bearing 75 and provided with a bearing 723 sleeved on the transmission shaft 61 for mounting the abutting member 721 on the transmission shaft 61 such that rotation of the transmission shaft 61 does not result in rotation of the abutting member 721. The first covering 65 is formed with a parallel pair of guiding plates 651 which cooperatively confine a guiding groove 652 therebetween. The wedging block 722 has a retaining part 724 which extends into the guiding groove 652 and which is received movably in the guiding groove 652.

When the threaded shank 73 is threaded inwardly, the retaining part 724 of the wedging block 722 slides along the guiding groove 652, and the wedging face 725 of the abutting member 721 is moved inwardly by the wedge face 726 of the wedging block 722 to apply a compression force on the second resistance bearing 75, and, in turn, the first balancing weight 63 and the first resistance bearing 71, thereby increasing the resistance to rotation of the transmission shaft 61. Conversely, to reduce the resistance to rotation of the transmission shaft 61, the shank 73 is threaded outwardly of the first covering 65. Therefore, the resistance to rotation of the transmission shaft 61 can be adjusted by threading the shank 73 of the operating unit 72 inwardly and outwardly.

It has thus been shown that the resistance device of the present invention can be used with an exerciser having a wheel and driving means for driving the wheel, such as a bicycle. The resistance device is capable of supporting the wheel of the exerciser above the ground surface and of providing resistance to the wheel for exercising purposes. In the preferred embodiments, adjustable resistance means are provided to adjust the resistance to the wheel to suit the user's requirement.

With this invention thus explained, it is apparent that numerous modifications and variations can be made without departing from the scope and spirit of this invention. It is therefore intended that this invention be limited only as indicated in the appended claims.

I claim:

1. A resistance device for an exerciser with an axle, a wheel mounted on the axle, and a driving unit which is manually operable to drive rotatable the wheel on the axle, said resistance device comprising:

a support frame adapted to be mounted on the exerciser so as to raise the wheel above a ground surface to prevent the ground surface from providing resistance to rotation of the wheel; and a resistance unit including a transmission shaft mounted rotatable on said support frame and adapted to be driven rotatable by the wheel, said transmission shaft having opposite first and second end portions and weighting means applied on said transmission shaft so as to generate a resistance to rotation of said transmission shaft in order to resist, in turn, the rotation of the wheel, said weighting means including first and second balancing weights sleeved respectively on said first and second end portions of said transmission shaft for co-rotation therewith;

a contact roller sleeved on said transmission shaft and adapted to be placed in contact with the wheel such that rotation of the wheel by the driving unit results in co-rotation of said contact roller and said transmission shaft therewith;

parallel first and second support members mounted on said support frame, each of said support members having a mounting hole provided with a bearing unit for supporting rotatable a respective one of said first and second end portions of said transmission shaft thereon, said contact roller being disposed between said support members;

a covering which is mounted on and which cooperates with said first support member to confine an accommodation chamber for enclosing said first balancing weight therein;

a first resistance bearing sleeved on said first end portion of said transmission shaft and disposed between said first support member and a first side of said first balancing weight, said first resistance bearing including a first race adjacent to said first support member, a second race adjacent to said first balancing weight, and first bearing balls disposed between said first and second races;

a second resistance bearing sleeved on said first end portion of said transmission shaft and disposed on a second side of said first balancing weight opposite to said first side, said second resistance bearing including a third race adjacent to said first balancing weight, a fourth race, and second bearing balls disposed between said third and fourth races; and adjustable resistance means for urging said second resistance bearing toward said first balancing weight, and for urging said first balancing weight toward said first resistance bearing such that said second and third races rotate with said first balancing weight relative to said first and fourth races, said adjustable resistance means being adjustable to vary compression force applied thereby to said second resistance bearing so as to vary resistances of said first and second bearing balls to rotation of said second and third races to adjust, in turn, resistance to rotation of said first balancing weight together with said transmission shaft.

2. The resistance device as claimed in claim 1, wherein said support frame includes a first frame portion with a parallel pair of first arms sections, and a second frame portion with a parallel pair of second arm sections mounted pivotally, foldably and respectively to said first arm sections of said first frame portion.

3. The resistance device as claimed in claim 1, wherein said support frame includes a U-shaped frame portion with a parallel pair of upright arm sections, said arm sections forming a space which is adapted to permit extension of the wheel therebetween, one of said arm sections having a first positioning tube, the other one of said arm sections having a second positioning tube coaxial with said first positioning tube, said second positioning tube being mounted movable on the other one of said arm sections to permit movement thereof toward and away from said first positioning tube, said first and second positioning tube being adapted to receive opposite ends of the axle so as to support the wheel at a raised position above the ground surface.

4. The resistance device as claimed in claim 1, wherein said support frame is adapted to be mounted removably on the exerciser.

5. The resistance device as claimed in claim 4, wherein the exerciser is a bicycle, and the wheel is a rear wheel of the bicycle.

6. The resistance device as claimed in claim 1, wherein said adjustable resistance means comprises:

an operating unit having a first portion extending into said covering and a second portion extending out of said covering to permit manual operation thereof; and an abutting member having a first side abutting against said first portion of said operating unit and a second side abutting against said fourth race of said second resistance bearing;

said operating unit being operable to vary the compression force applied by said abutting member on said fourth race of said second resistance bearing.

7. The resistance device as claimed in claim 6, wherein said operating unit has a threaded section between said first and second portions thereof, said covering being formed with a threaded hole which engages said threaded section of said operating unit, said first portion of said operating unit having a stop plate provided thereon, said abutting member being formed as a coiled spring with said first side thereof abutting against said stop plate.

8. The resistance device as claimed in claim 7, wherein said coiled spring is a spiral spring.

9. The resistance device as claimed in claim 6, wherein:

said operating unit includes a threaded shank which serves as said second portion of said operating unit, and a wedging block which is secured to one end of said threaded shank and which serves as said first portion of said operating unit, said wedging block being formed with an inclined wedge face;

said covering being formed with a threaded hole which engages said threaded shank;

said second side of said abutting member being provided with a bearing for mounting said abutting member on said first end portion of said transmission shaft such that rotation of said transmission shaft does not result in rotation of said abutting member, said first side of said abutting member being formed as an inclined wedging face which confronts said wedge face of said wedging block;

whereby, operation of said threaded shank results in relative movement between said abutting member and said wedging block to result in varying of the compression force applied by said abutting member on said fourth race of said second resistance bearing.

10. The resistance device as claimed in claim 9, wherein said covering is formed with a parallel pair of guiding plates which cooperatively confine a guiding groove for receiving said wedging block movably therebetween.

11. A resistance device for an exerciser with an axle, a wheel mounted on the axle, and a driving unit which is manually operable to drive rotatable the wheel on the axle, said resistance device comprising:

a support frame adapted to be mounted on the exerciser so as to raise the wheel above a ground surface to prevent the ground surface from providing resistance to rotation of the wheel; and a resistance unit including a transmission shaft mounted rotatable on said support frame and adapted to be driven rotatable by the wheel, said transmission shaft having opposite first and second end portions and weighting means applied on said transmission shaft so as to generate a resistance to rotation of said transmission shaft in order to resist, in turn, the rotation of the wheel, said weighting means including first and second balancing weights sleeved respectively on said first and second end portions of said transmission shaft for co-rotation therewith;

a contact roller sleeved on said transmission shaft and adapted to be placed in contact with the wheel such that rotation of the wheel by the driving unit results in co-rotation of said contact roller and said transmission shaft therewith;

parallel first and second support members mounted on said support frame, each of said support members having a mounting hole provided with a bearing unit for supporting rotatable a respective one of said first and second end portions of said transmission shaft thereon, said contact roller being disposed between said support members;

an adjustable positioning unit including:

a horizontal positioning plate having a first end portion secured to said support frame, and an opposite second end portion formed with an upwardly extending wall;

an upright pivot plate having an upper end portion disposed between and secured to said support members, and a lower end portion mounted pivotally on said first end portion of said positioning plate;

a regulating plate having a lower end portion mounted pivotally on said positioning plate between said first and second end portions of said positioning plate, and an upper end portion which permits resting of said pivot plate inclinedly thereon; and a regulating rod extending threadedly through said upwardly extending wall and abutting against said regulating plate, said regulating plate being operable so as to support said regulating plate in a desired inclined position, thereby permitting varying of inclination of said pivot plate to vary, in turn, position of said contact roller relative to the wheel.

12. The resistance device as claims in claim 11, wherein said support frame includes a first frame portion with a parallel pair of first arms sections, and a second frame portion with a parallel pair of second arm sections mounted pivotally, foldably and respectively to said first arm sections of said first frame portion.

13. The resistance device as claimed in claim 11, wherein said support frame includes a U-shaped frame portion with a parallel pair of upright arm sections, said arm sections forming a space which is adapted to permit extension of the wheel therebetween, one of said arm sections having a first positioning tube, the other one of said arm sections having a second positioning tube coaxial with said first positioning tube, said second positioning tube being mounted movable on the other one of said arm sections to permit movement thereof toward and away from said first positioning tube, said first and second positioning tube being adapted to receive opposite ends of the axle so as to support the wheel at a raised position above the ground surface.

14. The resistance device as claimed in claim 11, wherein said support frame is adapted to be mounted removably on the exerciser.

15. The resistance device as claimed in claim 14, wherein the exerciser is a bicycle, and the wheel is a rear wheel of the bicycle.

* * * * *